US010210822B2

(12) United States Patent
Zhang et al.

(10) Patent No.: US 10,210,822 B2
(45) Date of Patent: Feb. 19, 2019

(54) BACKLIGHT BRIGHTNESS CONTROL METHOD, APPARATUS, AND LIQUID CRYSTAL DISPLAY DEVICE

(71) Applicant: HISENSE ELECTRIC CO., LTD., Qingdao (CN)

(72) Inventors: Yuxin Zhang, Qingdao (CN); Zhicheng Song, Qingdao (CN); Shaowei Wu, Qingdao (CN)

(73) Assignee: Hisense Electric Co., Ltd., Qingdao (CN)

( * ) Notice: Subject to any disclaimer, the term of this patent is extended or adjusted under 35 U.S.C. 154(b) by 0 days.

(21) Appl. No.: 15/816,416

(22) Filed: Nov. 17, 2017

(65) Prior Publication Data

US 2018/0075813 A1 Mar. 15, 2018

Related U.S. Application Data

(63) Continuation of application No. PCT/CN2015/081669, filed on Jun. 17, 2015.

(30) Foreign Application Priority Data

May 18, 2015 (CN) ..... 2015 1 0253365

(51) Int. Cl.
*G09G 3/36* (2006.01)
*G09G 3/34* (2006.01)

(52) U.S. Cl.
CPC ..... *G09G 3/3426* (2013.01); *G09G 3/34* (2013.01); *G09G 3/36* (2013.01);
(Continued)

(58) Field of Classification Search
CPC ... G09G 3/36; G09G 5/10; G09G 3/34; F21V 7/04; G02F 1/13; G02F 1/1335;
(Continued)

(56) References Cited

U.S. PATENT DOCUMENTS

2007/0097069 A1 5/2007 Kurokawa et al.
2008/0284719 A1* 11/2008 Yoshida ..... G02F 1/136277 345/102

(Continued)

FOREIGN PATENT DOCUMENTS

CN 102097071 6/2011
CN 102292757 12/2011

(Continued)

OTHER PUBLICATIONS

Office Action from corresponding Chinese Application No. 201410267408.5 dated Jul. 10, 2017 (9 pages).

(Continued)

*Primary Examiner* — Pegeman Karimi
(74) *Attorney, Agent, or Firm* — Harness, Dickey & Pierce, P.L.C.

(57) ABSTRACT

Disclosed are a method and apparatus for controlling backlight brightness, and a liquid crystal display device, and the method for controlling backlight brightness includes: determining a backlight duty ratio of each backlight zone according to a backlight value of each backlight zone; determining a gain backlight current value of a backlight area according to an average backlight value of the backlight area, and a preset gain curve, wherein each backlight area corresponds to at least one backlight driving chip, and the at least one backlight driving chip controls in parallel more than one backlight zones in the backlight area corresponding to the at least one driving chip; generating a pulse modulation signal of each backlight zone according to the backlight duty ratio of corresponding backlight zone and the gain backlight current value; and adjusting a backlight current of the corresponding backlight zone according to the pulse modulation signal.

20 Claims, 9 Drawing Sheets

(52) U.S. Cl.
CPC ..... *G09G 2320/0233* (2013.01); *G09G 2320/0238* (2013.01); *G09G 2320/0247* (2013.01); *G09G 2320/064* (2013.01); *G09G 2320/066* (2013.01); *G09G 2320/0686* (2013.01); *G09G 2330/021* (2013.01); *G09G 2360/16* (2013.01)

(58) Field of Classification Search
CPC .... G02F 1/1333; G02F 1/1368; G02F 1/1339; H01L 27/12
See application file for complete search history.

(56) References Cited

U.S. PATENT DOCUMENTS

| | | | | |
|---|---|---|---|---|
| 2010/0066657 | A1 | 3/2010 | Park et al. | |
| 2010/0066752 | A1 | 3/2010 | Watanuki | |
| 2011/0007100 | A1* | 1/2011 | Yoshida | G02F 1/133603 345/690 |
| 2013/0120471 | A1 | 5/2013 | Lin et al. | |
| 2013/0222221 | A1* | 8/2013 | An | G09G 3/3426 345/102 |
| 2015/0161932 | A1 | 6/2015 | Kure et al. | |
| 2015/0364111 | A1* | 12/2015 | Zhang | G09G 5/10 345/690 |
| 2015/0365621 | A1* | 12/2015 | Zhang | G09G 5/005 348/791 |

FOREIGN PATENT DOCUMENTS

| | | |
|---|---|---|
| CN | 102622990 | 8/2012 |
| CN | 103106875 | 5/2013 |
| CN | 103295542 | 9/2013 |
| CN | 105469746 | 4/2016 |
| JP | 2013246185 A | 12/2013 |

OTHER PUBLICATIONS

International Search Report from corresponding PCT Application No. PCT/CN2015/081669 dated Feb. 6, 2016 (2 pages).
Office Action from Chinese Application No. 201510253365.X dated Jun. 19, 2018 (8 pages).
Extended European Search Report from European Patent Application No. 15892268.2 dated Jun. 18, 2018 (17 pages).

* cited by examiner

BACKLIGHT BRIGHTNESS CONTROL METHOD, APPARATUS, AND LIQUID CRYSTAL DISPLAY DEVICE

CROSS-REFERENCE TO RELATED APPLICATIONS

This application is a continuation of International Application No. PCT/CN2015/081669 filed Jun. 17, 2015, which claims the benefit and priority of Chinese Patent Application No. 201510253365.X filed May 18, 2015. The entire disclosures of the above applications are incorporated herein by reference.

FIELD

The present disclosure relates to the field of liquid crystal display technologies, and particularly to a method and apparatus for controlling backlight brightness, and a liquid crystal display device.

BACKGROUND

This section provides background information related to the present disclosure which is not necessarily prior art.

At present, liquid crystal display devices are an important research focus in the field of display technologies. Since panels of liquid crystal display devices are not self-illuminating products, the liquid crystal display devices need to be provided with backlight by arranging their backlight sources.

In an existing liquid crystal display device, the backlight is generally controlled in backlight zones, that is, the backlight source is divided into a plurality of backlight zones, backlight values corresponding to the respective backlight zones are calculated statistically, and duty ratios of the respective backlight zones are determined according to their corresponding backlight values; and then the duty ratios are adjusted on the backlight zones based upon a backlight reference current value, so that backlight brightness corresponding to the backlight values of the respective backlight zones are exhibited in the backlight zones, as such the backlight brightness in the different backlight zones are controlled.

SUMMARY

This section provides a general summary of the disclosure, and is not a comprehensive disclosure of its full scope or all of its features.

Some embodiments of the disclosure provide a method for controlling backlight brightness, applicable to a backlight module including a plurality of backlight zones, each of which includes one or more point light sources, wherein the method includes:

determining a gain backlight current value of a backlight area according to an average backlight value of the backlight area, and a preset gain curve, wherein each backlight area corresponds to at least one backlight driving chip, and the at least one backlight driving chip controls in parallel more than one backlight zones in the backlight area corresponding to the at least one backlight driving chip;

generating a pulse modulation signal of each backlight zone according to the backlight duty ratio of corresponding backlight zone and the gain backlight current value; and adjusting a backlight current of the corresponding backlight zone according to the pulse modulation signal.

Some other embodiments of the disclosure further provide an apparatus for controlling backlight brightness, applicable to a backlight module including a plurality of backlight zones, each of which includes one or more point light sources, wherein the apparatus includes:

a backlight processor configured to determine a backlight duty ratio of each backlight zone according to a backlight value of each backlight zone, wherein the backlight value of each backlight zone is determined by brightness data of an image zone corresponding to the backlight zone; and to determine a gain backlight current value of a backlight area according to an average backlight value of the backlight area, and a preset gain curve, wherein each backlight area corresponds to at least one backlight driving chip, and the at least one backlight driving chip controls in parallel more than one backlight zones in the backlight area corresponding to the at least on backlight driving chip;

the backlight driving chip configured to generate a pulse modulation signal of each backlight zone according to the backlight duty ratio of corresponding backlight zone and the gain backlight current value, and to send the pulse modulation signal to a backlight driving circuit; and the backlight driving circuit configured to adjust a backlight current of the corresponding backlight zone according to the pulse modulation signal.

Some other embodiments of the disclosure further provide a display device including an apparatus for controlling backlight brightness applicable to a backlight module including a plurality of backlight zones, each of which includes one or more point light sources, wherein the apparatus includes:

a backlight processor configured to determine a backlight duty ratio of each backlight zone according to a backlight value of each backlight zone, wherein the backlight value of each backlight zone is determined by brightness data of an image zone corresponding to the backlight zone; and to determine a gain backlight current value of a backlight area according to an average backlight value of the backlight area, and a preset gain curve, wherein each backlight area corresponds to at least one backlight riving chip, and the at least one backlight driving chip controls in parallel more than one backlight zones in the backlight area corresponding to the at least one backlight driving chip;

the backlight driving chip configured to generate a pulse modulation signal of each backlight zone according to the backlight duty ratio of corresponding backlight zone and the gain backlight current value, and to send the pulse modulation signal to a backlight driving circuit; and the backlight driving circuit configured to adjust a backlight current of the corresponding backlight zone according to the pulse modulation signal.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Figure 1:
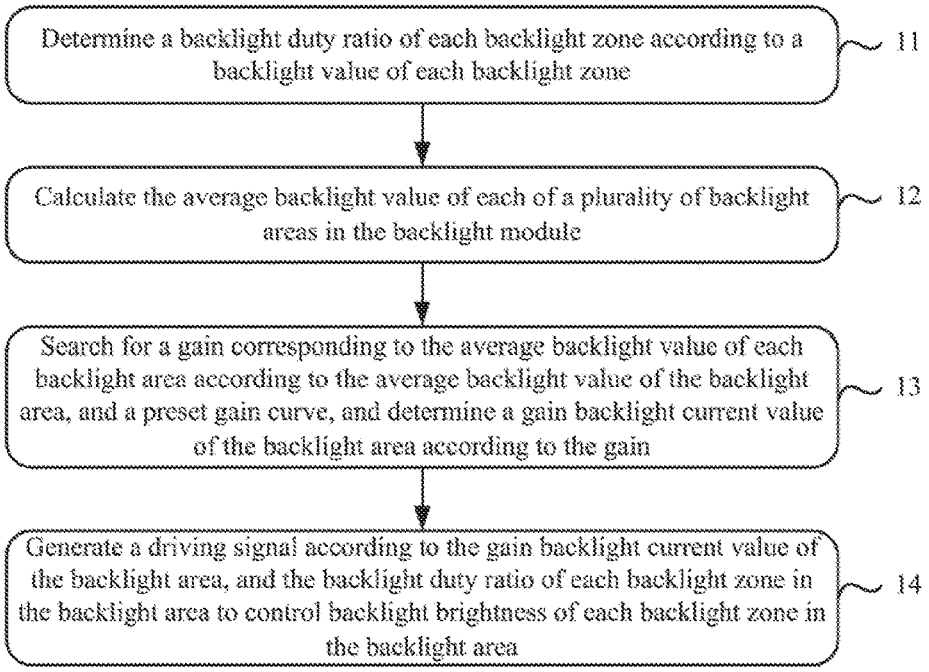
FIG. 1 is a schematic flow chart of a method for controlling backlight brightness according to some embodiments of the disclosure.

Example embodiments will now be described more fully with reference to the accompanying drawings.

In a common backlight control mode in the relevant art, since there is an insignificant difference between the backlight values calculated for the different backlight zones (the entire backlight portion in the liquid crystal display device typically can include a plurality of backlight zones, each of which corresponds to a plurality of backlight lamps), so that the backlight brightness exhibited really in the backlight zones may not well reflect the contrast and the layering to be exhibited.

Moreover, in order to improve diffusion of the backlight and alleviate shadowiness of the light in effect, the backlight source can be designed by further adding a secondary lens thereto. Since there is a large light diffusion area of each backlight lamp, e.g, LED, in the backlight source, and there are also complicated light paths intersections between the backlight lamps, e.g, LEDs, the backlight brightness throughout the backlight source remains uniform all the time, to thereby suppress the brightness from varying, and thus degrading the contrast of the image.

In some embodiments of the disclosure, on one hand, a backlight duty ratio of each backlight zone is determined according to a backlight value of each backlight zone; and on the other hand, a plurality of backlight areas in the backlight module is determined, the average backlight value of each backlight zone is calculated, a corresponding gain is searched for respectively using the calculated average backlight value, and the current backlight current value of the corresponding backlight area is multiplied with the gain to obtain a gain backlight current value of the backlight area; and then a driving signal is generated according to the gain backlight current value of the backlight area and the backlight duty ratio of each backlight zone in the backlight area, to control backlight brightness of each backlight zone in the backlight area. Since the backlight duty ratios are determined according to the backlight values of the corresponding backlight zones, thus dimming control in different levels can be performed on the backlight zones of the same backlight areas, and also the difference in backlight brightness between the different backlight zones of the same backlight areas can be improved to thereby improve the contrast between higher and lower brightness of a display image; and in some embodiments of the disclosure, the different gains can be further applied to the backlight current values of the different backlight areas so that there are different backlight current values of the different backlight areas, thus improving the contrast and the layering of the image being displayed more effectively, and avoiding the problem in the relevant art that there is the same gain throughout the backlight zones due to that all the backlight zones are controlled collectively, or there is an insignificant difference in brightness throughout the image being displayed and less pronounced layering thereof due to that the backlight brightness is adjusted simply by adjusting the backlight duty ratios. Furthermore in some embodiments of the disclosure, both the backlight duty ratios and the backlight current values can be adjusted so that even if the contrast can not be well improved by adjusting the backlight duty ratios, or if the backlight brightness can not be further improved after the backlight duty ratios are adjusted to 100%, then the backlight current may be adjusted so that there are different gains corresponding to the backlight current in the respective backlight areas, and in this way, the different backlight areas can be treated differently to thereby improve more effectively the contrast between higher and lower brightness of the different backlight areas so as to improve the effect of the image display on the liquid crystal display device.

As illustrated in FIG. 1, some embodiments of the disclosure provide a method for controlling backlight brightness, applicable to a backlight module, for which backlight needs to be controlled, and which includes a plurality of backlight zones. Each of the plurality of backlight zones includes one or more point light sources, and the plurality of backlight zones are controlled in parallel, here the method for controlling backlight brightness can include the following steps:

The step 11 is to determine a backlight duty ratio of each backlight zone according to a backlight value of each backlight zone.

Here the backlight value of each backlight zone is determined by brightness data of an image zone corresponding to the backlight zone.

Figure 2A:
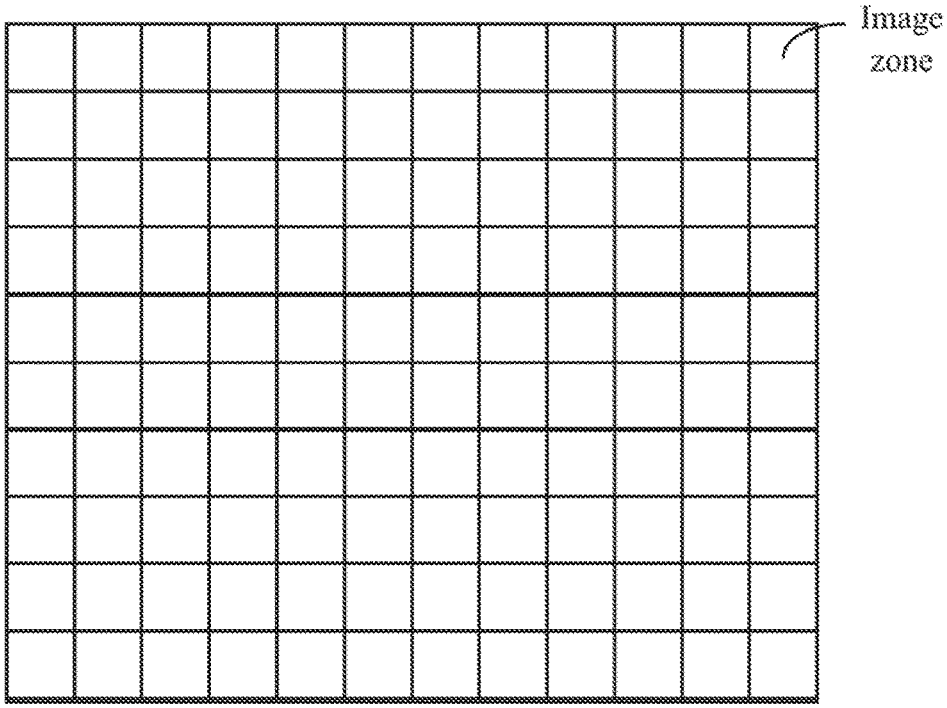
FIG. 2A shows a schematic diagram of a plurality of image zones into which a display area is divided by a according to some embodiments of the disclosure.

In some embodiments of the disclosure, in the step 11, firstly brightness data of a received current image frame are processed, for example, if there are N preset backlight zones in a backlight model, then the current image frame will be divided into N image zones (e.g., 120 image zones as illustrated in FIG. 2A, and a grayscale histogram of pixels in each image zone is calculated respectively; and furthermore the brightness data of each image zone (which may include a plurality of pixels) is calculated, and the brightness data of the N image zones are converted correspondingly into the backlight values of the N backlight zones.

There is the following relationship between backlight brightness B, and a backlight current value I and a backlight duty ratio D:

$$B=I*D \quad (1)$$

Please note that, in real implementation, there are mapping relationship between B and the product of I and D, which relationship can be obtained by the ordinary skill in the art with experience, and thus B may or may not be the product of I and D. If a backlight current value of a backlight source LED in the current backlight model is a preset reference value, then the backlight duty ratio of each backlight zone may be calculated according to the backlight value and the backlight current value of each backlight zone, where the preset reference value may be any of the present backlight current values, e.g., a backlight current reference value, or other preset backlight current value. In some embodiments of the disclosure, if the backlight current value is a fixed value, then the backlight duty ratio corresponding to the backlight value of the backlight zone will be calculated according to the backlight current value, so that the backlight duty ratio of each backlight zone is determined.

The step 12 is to calculate the average backlight value of each of a plurality of backlight areas in the backlight module.

Figure 2B:
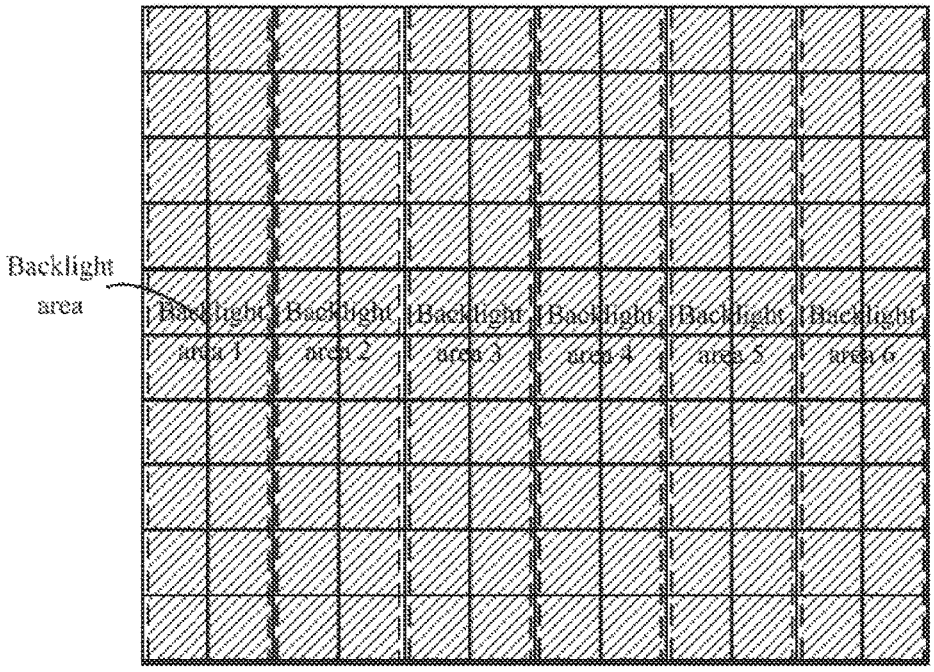
FIG. 2B shows a schematic diagram of a plurality of identically sized backlight areas into which a backlight module is divided by a division rule according to some embodiments of the disclosure.
Figure 2C:
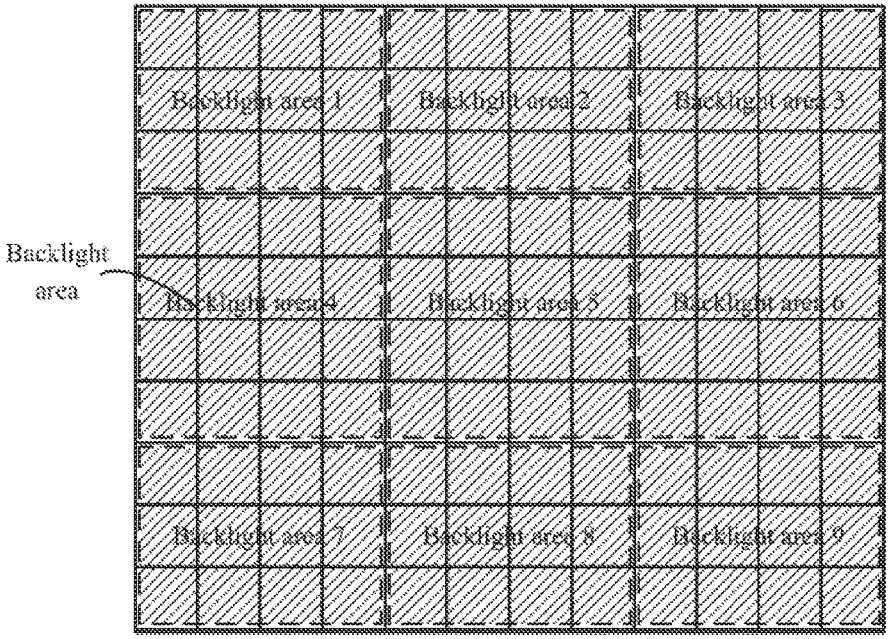
FIG. 2C is a schematic diagram of a plurality of distinctly sized backlight areas into which a backlight module is divided by another division rule according to some embodiments of the disclosure.

In some embodiments of the disclosure, in the step 12, still taking the backlight module above as an example, the N backlight zones can be divided according to any division rule, for example, in the transverse direction, in the longitudinal direction, in both the transverse and longitudinal directions, etc., obtaining M backlight areas with the same size, or M backlight areas with different sizes. For example, in order to control the backlight zones centrally, the backlight zones are divided so that the number of backlight zones may be an integer multiply of the number of the backlight areas into which they are divided, and there are the same area and shape of the M backlight areas into which they are divided, where both M and N are positive integers, and M is less than N. In some embodiments of the disclosure, the backlight zones can be uniformly divided in the longitudinal direction according to the division rule as illustrated in FIG. 2B where 120 backlight zones are divided into 6 backlight areas, or can be non-uniformly divided in both the transverse and longitudinal directions according to the division rule as illustrated in FIG. 2C(c) where 120 backlight zones are divided into distinctly sized 9 backlight areas. The backlight current values of the respective backlight areas into which the backlight zones are divided as illustrated in FIG. 2C can be adjusted in both the transverse and longitudinal directions to thereby better present the layering of the image.

The average backlight value in each backlight area is calculated respectively according to the backlight values of the backlight zones in each backlight area. For example, there are 20 backlight zones in a backlight area 1, and backlight values of these 20 backlight zones are summed and averaged into the average backlight value of the backlight area 1. This will also apply to the other backlight areas.

The step 13 is to search for a gain corresponding to the average backlight value of each backlight area according to the average backlight value of the backlight area, and a preset gain curve, and to determine a gain backlight current value of the backlight area according to the gain.

In some embodiments of the disclosure, in the step 11 above, the backlight duty ratio of each backlight zone is determined according to the backlight value of the corresponding backlight zone, so that a register of a corresponding output circuit can be adjusted using the backlight duty ratio to control the length of time for which the backlight source LED is switched on or off, so that different backlight brightness can be displayed in each backlight zone. But for the backlight sources with quadratic prism, the contrast of the displayed image can not be well guaranteed in this differentiated display scheme. In view of this, in some embodiments of the disclosure, after the corresponding backlight duty ratios are determined according to the backlight values of the respective backlight zones, the gain corresponding to each backlight area can be further searched for according to the average backlight value of each backlight area, and the preset gain curve, and the gain backlight current value of the backlight area can be determined according to the gain.

It shall be noted that the embodiments of the disclosure will not be limited to any particular order in which the step 11, and the steps 12 and 13 are performed, in some embodiments of the disclosure, firstly the backlight duty ratios, and then the average backlight values, and the gain backlight current values can be determined, or firstly the average backlight values, and the gain backlight current values, and then the backlight duty ratios can be determined.

In some embodiments of the disclosure, the gain backlight current value of the backlight area can be determined according to the gain by multiplying the backlight current value of the backlight area with the found gain to obtain the gain backlight current value of the backlight area.

Figure 2D:
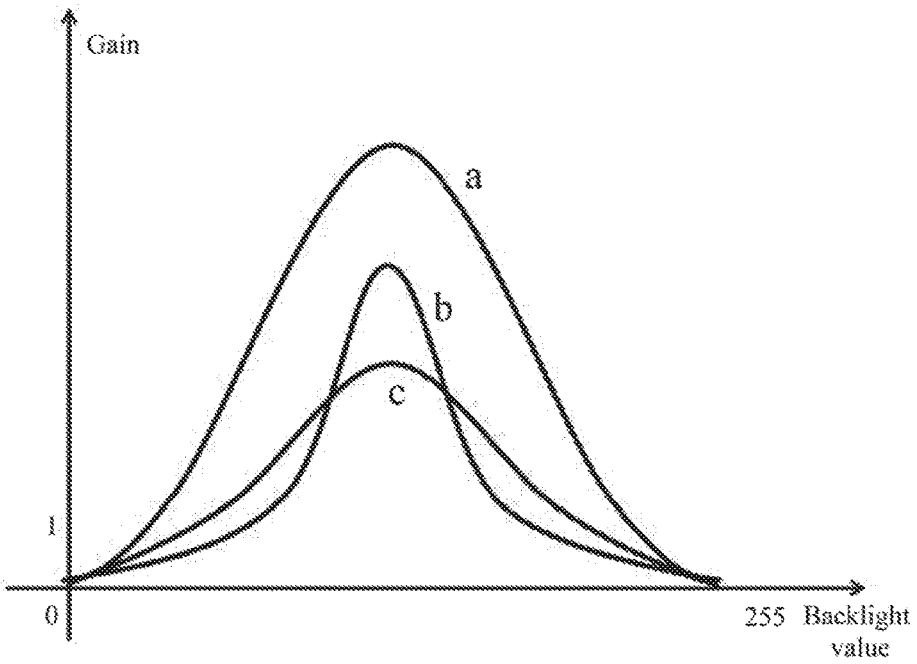
FIG. 2D shows a schematic diagram of three corresponding gain curves according to some embodiments of the disclosure.
Figure 2E:
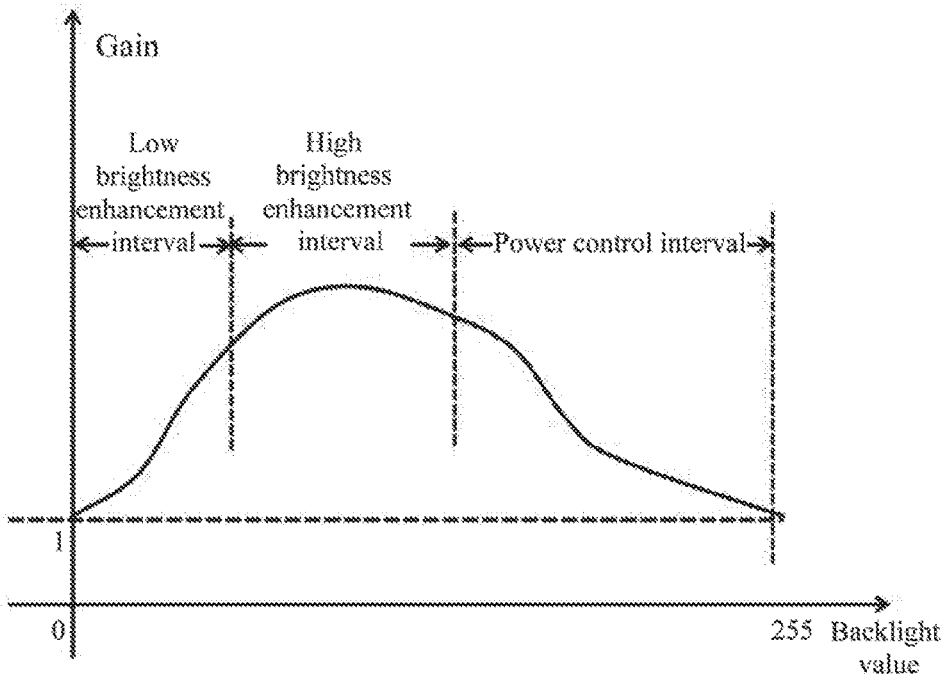
FIG. 2E shows a schematic diagram of a gain adjustment curve of a backlight value according to some embodiments of the disclosure.

Here the number of the preset gain curves may be no more than M, and they can be pre-stored in the backlight module for a subsequent search. For example, if there are 6 backlight areas, then sixth different gain curves may be preset, where each backlight area corresponds to separate one of the gain curves for a search therein for a gain, or one gain curve may be preset, where all of the 6 backlight areas correspond to the preset one gain curve for a search therein for a gain; or if there are 6 backlight areas, then 3 different gain curves may be preset. For example, if the backlight zones are divided into a backlight area 1 to a backlight area 6, and the determined average values of the backlight values thereof are 125, 189, 98, 176, 209, and 56 respectively; and as illustrated in FIG. 2D, the backlight areas 1 and 6 correspond to a gain curve c, the backlight areas 2 and 5 correspond to a gain curve b, and the backlight areas 3 and 4 correspond to a gain curve a, so that the backlight areas 3 and 4 located in the central area of the backlight module correspond to the gain curve with a higher gain amplitude, thus improving the contrast of the image in the central area as compared with the other areas. Accordingly at least one preset gain curve can be searched respectively for the gain corresponding to each backlight area as illustrated in FIG. 2E which is a schematic diagram of a gain curve according to some embodiments of the disclosure, where the abscissa represents a backlight value ranging from 0 to 255, and the ordinate represents a gain ranging from 1 to $+\infty$; however in some embodiments of the disclosure, the gain can range from 1 to 2 dependent upon a real demand for power setting, where the gain will not be limited to an integer, but may also be not an integer. In fact, each gain curve can be further divided into a low brightness enhancement interval, a high brightness enhancement interval, and a power control interval. If there is a low average backlight value in a backlight area, then there will be a gain in the low brightness enhancement interval; as the content displayed in the backlight area varies, when the average backlight value in the backlight area lies in the high brightness enhancement interval, there will be a gain in the high brightness enhancement interval, thus well highlighting a high-brightness segment in the image; and if there is a high average backlight value in the backlight area, then the brightness of the image throughout the backlight area will be so high that substantially no backlight needs to be further enhanced, but the effect of the backlight gain needs to be lowered due to power consumption. Since the determined average backlight values of the respective backlight areas are different from each other, the determined gains are also different from each other. Furthermore the backlight current values of the backlight zones in the corresponding backlight areas are multiplied respectively with the 6 found gains to obtain the gain backlight current values.

In the relevant art, if there is a high brightness image portion, a low brightness image portion, and an intermediate brightness image portion in the current image frame, and when the average brightness data of the current image frame are calculated, the value of the average brightness data typically lies in the high brightness enhancement interval of the gain curve to get a gain with a large number, thus increasing the brightness of all the corresponding backlight zones throughout the current image frame, and resulting in an increase in power as needed, which may hinder the contrast between high and low brightness from being improved. In some embodiments of the disclosure, the different gains of the different backlight areas can be searched for to thereby divide the backlight zones at different brightness into the different backlight areas as much as possible, so that the different gains are found for the different backlight areas instead of the same gain (which is a large gain) found for all the backlight zones, thus improving differently the brightness of the backlight zones corresponding to the entire image frame, consuming less power, and making it easier to control the gains obtained for the different backlight areas respectively so as to further improve the contrast and the layering of the displayed image.

The step 14 is to generate a driving signal according to the gain backlight current value of the backlight area, and the backlight duty ratio of each backlight zone in the backlight area to control backlight brightness of each backlight zone in the backlight area.

In some embodiments of the disclosure, before the step 14 is performed, it can be determined for any one of backlight areas whether the difference between the gain backlight current value and the present backlight current value is above a first preset threshold; when it is determined that the difference between the gain backlight current value and the present backlight current value is above the first preset threshold, then the gain backlight current value will be marked as valid so that the magnitude of a peak of a pulse signal of the backlight area is adjusted using the subsequently generated driving signal; when it is determined that the difference between the gain backlight current value and the present backlight current value is not above the first preset threshold, the gain backlight current value will be marked as invalid so that the magnitude of the peak of the pulse signal of the backlight area is not adjusted using the subsequently generated driving signal.

In some embodiments of the disclosure, the first preset threshold can be preset dependent upon the complexity of a backlight control circuit, and the gain backlight current value can be judged to avoid the backlight current from being adjusted frequently. If there is an insignificant difference between the gain backlight current value, and the present backlight current value, then the generation of the driving signal thereof will not contribute much to an improvement in brightness of the backlight area, but will complicate the adjustment and control process, and increase the difficulty of the control process. In view of this, in some embodiments of the disclosure, before the driving signal is generated, the gain backlight current value can be compared with the present backlight current value, and if their difference is above the first threshold, then it will indicate that there is a significant difference between the gain backlight current value and the present backlight current value, and some adjustment needs to be made, so the gain backlight current value will be marked as valid, and the driving signal corresponding to the backlight area will be generated according to the valid gain backlight current value, so that the magnitude of the peak of the pulse signal of the backlight area is adjusted using the generated driving signal; or if their difference is not above the first threshold, then it will indicate that there is an insignificant difference between the gain backlight current value, and the present backlight current value, and no adjustment needs to be made, so the gain backlight current value will be marked as invalid, and the driving signal corresponding to the backlight area will be generated according to the invalid gain backlight current value, so that the magnitude of the peak of the pulse signal of the backlight area is not adjusted using the generated driving signal. In this way, the backlight current can be avoided from being adjusted frequently, and the complexity of controlling and adjusting the backlight can be lower.

In some embodiments of the disclosure, after the step 13 is performed, and before the step 14 is performed, it can be further determined for any one backlight area whether the average backlight brightness obtained according to the currently determined backlight duty ratio and gain backlight current value is above a second preset threshold; when it is determined that the average backlight brightness obtained according to a currently determined backlight duty ratio of each backlight zone, and the gain backlight current value of the backlight area is above the second preset threshold, then a preset power adjustment curve will be invoked and searched for a power adjustment coefficient corresponding to the currently obtained backlight brightness of the backlight area, and the gain backlight current value will be multiplied with the power adjustment coefficient to obtain a revised backlight current value; and the driving signal will be generated according to the revised backlight current value of the backlight area, and the backlight duty ratio of each backlight zone in the backlight area to control the backlight brightness of each backlight zone in the backlight area.

Figure 3:
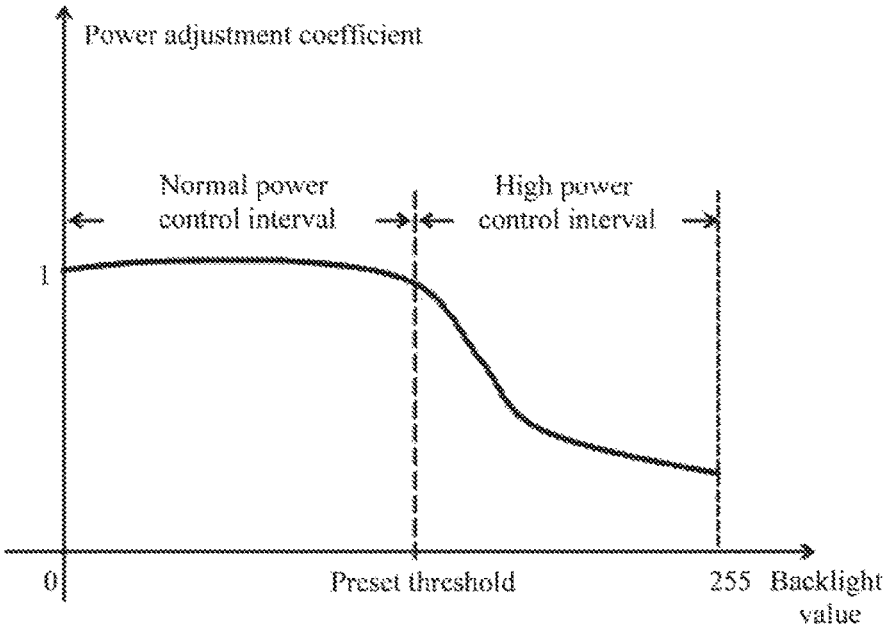
FIG. 3 shows a schematic diagram of a power adjustment curve according to some embodiments of the disclosure.

In some embodiments of the disclosure, the second preset threshold is typically approximately 70% of the highest brightness value 255, and as described above, any one backlight area is detected, for example, the backlight brightness is obtained according to the backlight duty ratio of each backlight zone in the backlight area, and the gain backlight current value, the backlight brightness is averaged into the average backlight brightness at the backlight value, and if the average backlight brightness is above the preset threshold, then the preset power adjustment curve will be searched for the power adjustment coefficient corresponding to the currently obtained backlight brightness of the backlight area, and the gain backlight current value is multiplied with the power adjustment coefficient to obtain the revised backlight current value, where the power adjustment curve can be pre-stored in the backlight model. FIG. 3 illustrates a schematic diagram of a power adjustment curve according to some embodiments of the disclosure, where the abscissa represents backlight brightness ranging from 0 to 255, and the ordinate represents an adjustment coefficient ranging from 0, exclusive, to 1. Since a power bearing capacity of the backlight module needs to be taken into account when improving the backlight current value of the backlight area, the average backlight brightness corresponding to the gain backlight current of the backlight area needs to be detected (pre-calculated) constantly, and if the average backlight brightness is above the second preset threshold, then it will indicate that the average backlight brightness of the backlight area has been saturated at this time, and even if the gain currently applied to the backlight current is provided to increase the backlight brightness, then the real backlight brightness thereof may not be significantly improved, but high power will be consumed. In view of this, in some embodiments of the disclosure, the preset power adjustment curve is searched for the power adjustment coefficient (typically less than 1) corresponding to the backlight area with the backlight brightness above the second preset threshold, and the gain backlight current value of all the backlight zones in the backlight area is further multiplied with the power adjustment coefficient, where although there is a resulting smaller backlight current gain, the brightness can also be improved while lowering power consumption of the backlight module. The power adjustment curve can be derived empirically, and then pre-stored in the backlight module.

In some embodiments of the disclosure, before the driving signal is generated according to the revised backlight current value of the backlight area, and the backlight duty ratio of each backlight zone in the backlight area, it can be further determined for any one backlight area whether the difference between the revised backlight current value and the present backlight current value is above a first preset threshold; when it is determined that the difference between the revised backlight current value and the present backlight current value is above the first preset threshold, then the revised backlight current value will be marked as valid so that the magnitude of a peak of a pulse signal of the backlight area is adjusted using the subsequently generated driving signal; when it is determined that the difference between the revised backlight current value and the present backlight current value is not above the first preset threshold, the revised backlight current value will be marked as invalid so that the magnitude of the peak of the pulse signal of the backlight area is not adjusted using the subsequently generated driving signal.

Furthermore in some embodiments of the disclosure, before the driving signal is generated, in order to reflect temporal correlation between image frames, and to display the consecutive image frames more smoothly, the obtained gain backlight current value, or the revised backlight current value can be further smoothed and filtered, for example, a weighted functional relationship between the current image frame and several preceding image frames can be preset, for example, a smoothed and filtered backlight current value of the backlight area 1 is $I'_N=(8*I_N+4*I_{(N-1)}+2*I_{(N-2)}+I_{(N-3)})/15$.

In some embodiments of the disclosure, the plurality of backlight areas can correspond to at least two different preset gain curves, where there is a higher gain amplitude of a preset gain curve corresponding to a backlight area located in the central area of the backlight module than gain amplitudes of preset gain curves corresponding to the other backlight areas.

In some embodiments of the disclosure, the gain backlight current value of the backlight area can be determined according to the gain by multiplying the backlight current value of the backlight area with the found gain to obtain the gain backlight current value of the backlight area.

In some embodiments of the disclosure, before the driving signal is generated according to the gain backlight current value of the backlight area, and the backlight duty ratio of each backlight zone in the backlight area, the method further includes: it is determined for any one backlight area whether the difference between the gain backlight current value, and the present backlight current value is above a first preset threshold; when it is determined that the difference between the gain backlight current value, and the present backlight current value is above the first preset threshold, then the gain backlight current value will be marked as valid so that the magnitude of a peak of a pulse signal of the backlight area is adjusted using the subsequently generated driving signal; when it is determined that the difference between the gain backlight current value, and the present backlight current value is not above the first preset threshold, the gain backlight current value will be marked as invalid so that the magnitude of the peak of the pulse signal of the backlight area is not adjusted using the subsequently generated driving signal.

In some embodiments of the disclosure, after the backlight duty ratios, and the gain backlight current value of each backlight area are determined, the method can further include: it is determined for any one backlight area whether the average backlight brightness obtained according to the currently determined backlight duty ratio of each backlight zone, and the gain backlight current value of the backlight area is above a second preset threshold; when it is determined that the average backlight brightness obtained according to the currently determined backlight duty ratio of each backlight zone, and the gain backlight current value of the backlight area is above the second preset threshold, then a preset power adjustment curve will be invoked and searched for a power adjustment coefficient corresponding to the currently obtained backlight brightness of the backlight area, and the gain backlight current value will be multiplied with the power adjustment coefficient to obtain a revised backlight current value.

The driving signal will be generated according to the revised backlight current value of the backlight area, and the backlight duty ratio of each backlight zone in the backlight area to control the backlight brightness of each backlight zone in the backlight area.

In some embodiments of the disclosure, before the driving signal is generated according to the revised backlight current value of the backlight area, and the backlight duty ratio of each backlight zone in the backlight area, the method further includes: it is determined for any one backlight area whether the difference between the revised backlight current value and the present backlight current value is above a first preset threshold; when it is determined that the difference between the revised backlight current value and the present backlight current value is above the first preset threshold, then the revised backlight current value will be marked as valid so that the magnitude of a peak of a pulse signal of the backlight area is adjusted using the subsequently generated driving signal; when it is determined that the difference between the revised backlight current value and the present backlight current value is not above the first preset threshold, the revised backlight current value will be marked as invalid so that the magnitude of the peak of the pulse signal of the backlight area is not adjusted using the subsequently generated driving signal.

In some embodiments of the disclosure, if there are N preset backlight zones, the N backlight zones can be divided according to any division rule to obtain M backlight areas, and at least one backlight area includes more than one backlight zones, where each backlight area corresponds to at least one backlight driving chip, and at least one of the backlight driving chips control in parallel more than one backlight zones in the backlight area corresponding to the backlight driving chip. Furthermore in some embodiments of the disclosure, the different gains can be further applied to the backlight current values of the different backlight areas so that there are different backlight current values of the different backlight areas, thus improving the contrast and the layering of the image being displayed. Since there is at least one backlight areas including more than one backlight zones, it may lower the complexity to adjust the driving circuit, and reduce the power consumption to adjust the backlight brightness.

In some embodiments of the disclosure, the backlight value of each backlight zone is determined, and on one hand, the backlight duty ratio of each backlight zone is determined according to the backlight value of each backlight zone; and on the other hand, the plurality of backlight areas in the backlight module is determined, the average backlight value of each backlight area is calculated statistically, the corresponding gain is searched for respectively using the calculated average backlight value, and the present backlight current value of the corresponding backlight area is multiplied with the gain to obtain the gain backlight current value of the backlight area; and then the driving signal is generated according to the gain backlight current value of the backlight area, and the backlight duty ratio of each backlight zone in the backlight area to control backlight brightness of each backlight zone in the backlight area. Since the backlight duty ratios are determined according to the backlight values of the corresponding backlight zones, dimming control in different levels can be performed on the backlight zones, and also the difference in backlight brightness between the different backlight zones can be improved to thereby improve the contrast between higher and lower brightness of the displayed image; and of the most importance, in some embodiments of the disclosure, the gains can be further applied to the backlight current values of the different backlight areas so that there are different backlight current values of the different backlight areas, thus improving the contrast and the layering of the image being displayed more effectively. In some embodiments of the disclosure, both the backlight duty ratios and the backlight current values may be adjusted so that even if the contrast between the backlight zones can not be well improved by adjusting the backlight duty ratios, or if the backlight brightness can not be further improved after the backlight duty ratios are adjusted to 100%, then the backlight current may be adjusted so that there are different gains corresponding to the backlight current in the respective backlight areas, and in this way, the different backlight areas can be treated differently to thereby improve the contrast more effectively between higher and lower brightness of the different backlight areas so as to improve the effect of the image display on the liquid crystal display device.

Figure 4:
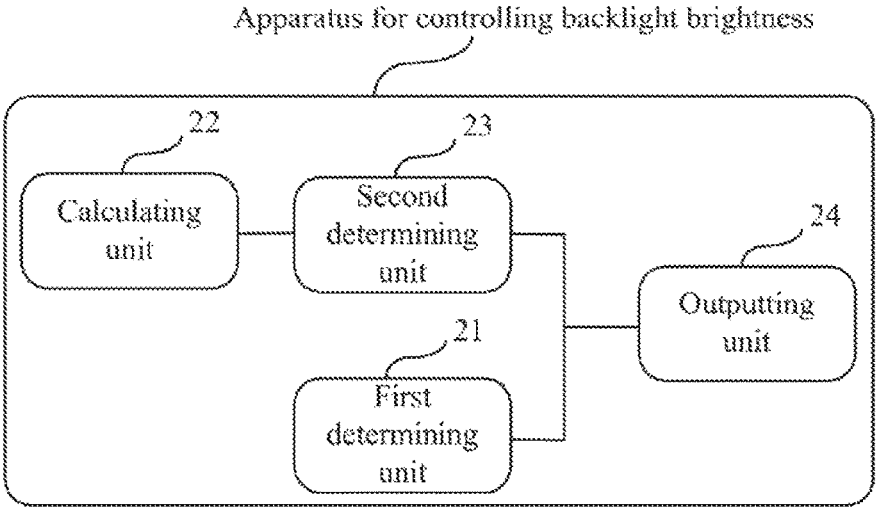
FIG. 4 is a schematic structural diagram of an apparatus for controlling backlight brightness according to some embodiments of the disclosure.

As illustrated in FIG. 4 which is a schematic structural diagram of an apparatus for controlling backlight brightness according to some embodiments of the disclosure, the apparatus for controlling backlight brightness includes the following units:

A first determining unit 21 is configured to determine a backlight duty ratio of each backlight zone according to a backlight value of each backlight zone, where the backlight value of each backlight zone is determined by brightness data of an image zone corresponding to the backlight zone.

A calculating unit 22 is configured to calculate the average backlight value of each of a plurality of backlight areas in the backlight module.

A second determining unit 23 is configured to search for a gain corresponding to the average backlight value of each backlight area according to the average backlight value of the backlight area, and a preset gain curve, and to determine a gain backlight current value of the backlight area according to the gain, and preferably, the second determining unit 23 is configured to multiply the backlight current value of the backlight area with the found gain to obtain the gain backlight current value of the backlight area.

An outputting unit 24 is configured to generate a driving signal according to the gain backlight current value of the backlight area, and the backlight duty ratio of each backlight zone in the backlight area to control backlight brightness of each backlight zone in the backlight area.

In some embodiments of the disclosure, the first determining unit can be a converting unit integrated in a converting chip, and configured to obtain an image frame, to calculate brightness data of each image zone of the image frame, and to convert the calculated brightness data of each image zone into a backlight value of the corresponding backlight zone, i.e., backlight brightness to be displayed by the backlight module; and in some embodiments of the disclosure, since the backlight module needs to be controlled dynamically in zones, the backlight brightness to be displayed in the backlight areas into which the backlight zones are divided may not be the initially determined backlight values, and since gains are further applied to the backlight current values as described below, the backlight values of the backlight zones obtained here are only ideal backlight values. The calculating unit, the second determining unit, and the outputting unit can be integrated together in a backlight processing chip connected with the converting chip.

In some embodiments of the disclosure, the plurality of backlight areas in the backlight module correspond to at least two different preset gain curves, where there is a higher gain amplitude of a preset gain curve corresponding to a backlight area located in the central area of the backlight module than gain amplitudes of preset gain curves corresponding to the other backlight areas.

Figure 5:
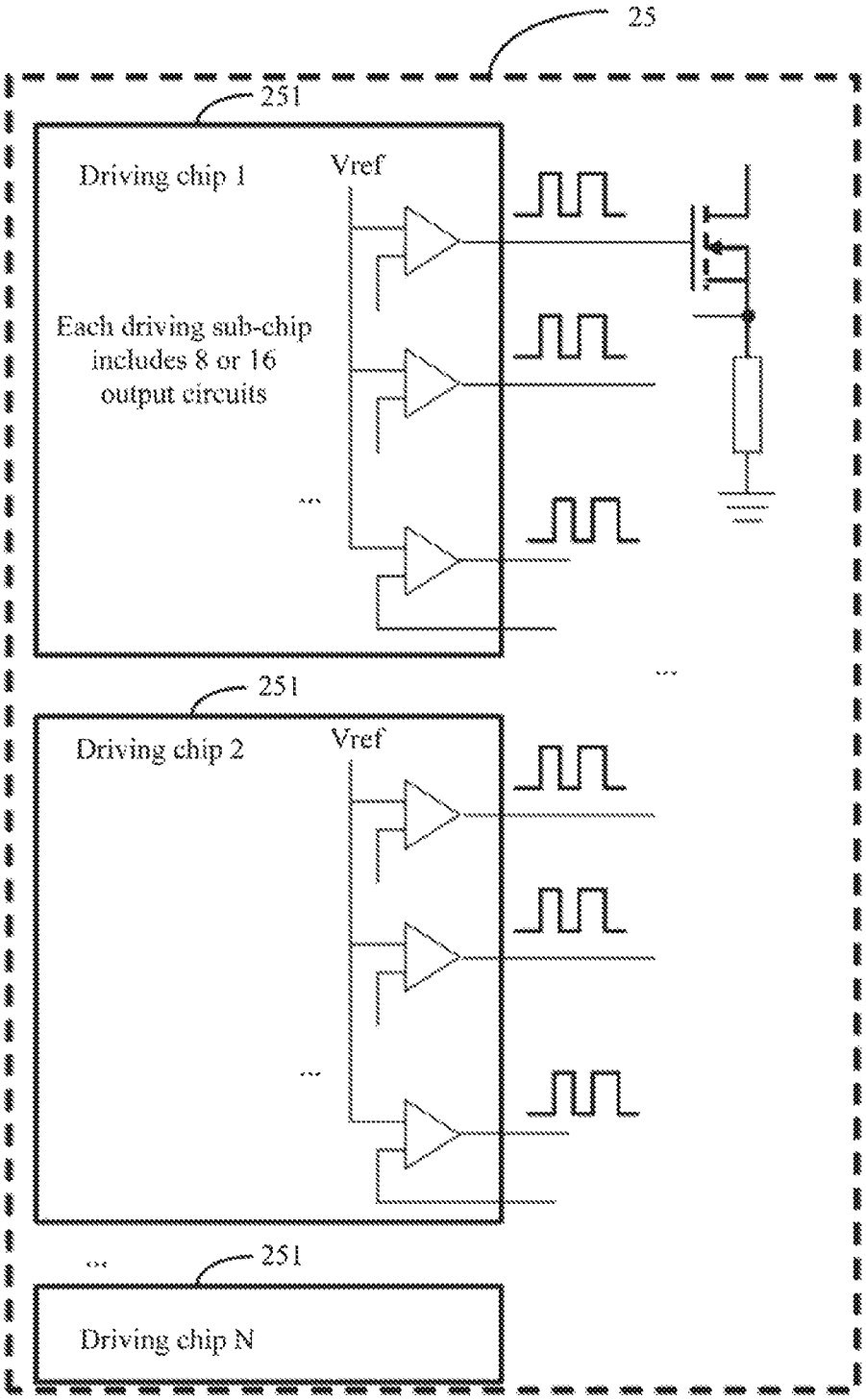
FIG. 5 is a schematic diagram of a pulse driving circuit in a control unit according to some embodiments of the disclosure.
Figure 6:
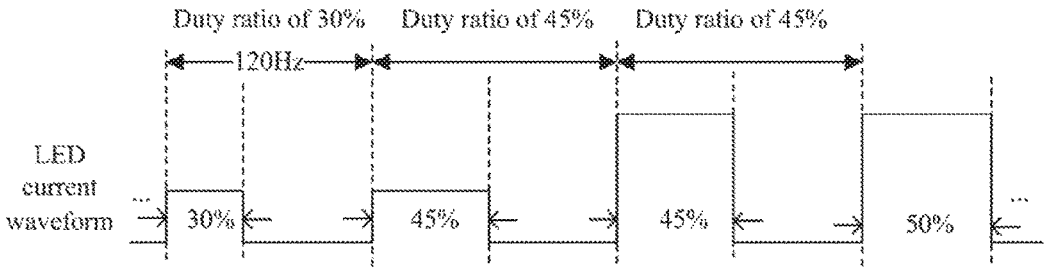
FIG. 6 shows a schematic diagram of a current waveform in a backlight source LED according to some embodiments of the disclosure.

In some embodiments of the disclosure, the apparatus for controlling backlight brightness can further include a marking unit configured to determine for any one backlight area whether the difference between the gain backlight current value and the present backlight current value is above a first preset threshold; when it is determined that the difference between the gain backlight current value and the present backlight current value is above the first preset threshold, to mark the gain backlight current value as valid so that the magnitude of a peak of a pulse signal of the backlight area can be adjusted using the subsequently generated driving signal; when it is determined that the difference between the gain backlight current value and the present backlight current value is not above the first preset threshold, to mark the gain backlight current value as invalid so that the magnitude of the peak of the pulse signal of the backlight area is not adjusted using the subsequently generated driving signal. For example, the generated driving signal needs to be transmitted to a backlight driving circuit as illustrated in FIG. 5 for the purpose of driving control, where the backlight driving circuit 25 includes a plurality of driving chips 251, each of which is connected with several driving output circuits (typically there are 8 or 16 output circuits connected with a driving chip), each driving output circuit is connected with and controls one of the backlight zones, and typically each backlight area is controlled by at least one driving chip 251, in each of which there is preset reference voltage Vref, so that each driving chip 251 can be controlled separately, and there may be different reference voltage for adjustment control by each driving chip 251, so there is the same magnitude of a peak of the backlight current value output by the same driving chip 251, and there may be different magnitudes of the peaks of the backlight current values output by the different driving chips 251, so that LED lamps in the backlight source can be controlled separately in areas. As illustrated in FIG. 6 which shows a schematic diagram of a current waveform of a backlight source LED according to some embodiments of the disclosure, apparently for each backlight area, the duty ratio of the current in the backlight source LED can be adjusted by controlling a register using the determined backlight duty ratio of each backlight zone, and the magnitude of the peak of the current in the backlight source LED can be adjusted by adjusting the reference voltage of each driving chip 251, but in order to avoid the brightness of the LED from being changed sharply and flickering due to the current being adjusted frequently, a hysteretic compare performed by the marking unit above can be further performed on the gain backlight current value and the first preset threshold, and only if the difference between the gain backlight current value and the present backlight current value is detected to be above the first preset threshold, then the current in the backlight driving circuit will be adjusted, and also the current will be temporally smoothed and filtered.

In some embodiments of the disclosure, the apparatus for controlling backlight brightness can further include a detecting unit and a revising unit, where the detecting unit is configured to determine for any one backlight area whether the average backlight brightness obtained according to the currently determined backlight duty ratio of each backlight zone, and gain backlight current value of the backlight area is above a second preset threshold; when it is determined that the average backlight brightness obtained according to the currently determined backlight duty ratio of each backlight zone, and gain backlight current value of the backlight area is above the second preset threshold, then the revising unit will be configured to invoke and search a preset power adjustment curve for a power adjustment coefficient corresponding to the currently obtained backlight brightness of the backlight area, and to multiply the gain backlight current value with the power adjustment coefficient to obtain a revised backlight current value; and the outputting unit 24 is further configured to generate the driving signal according to the backlight duty ratio of each backlight zone determined by the first determining unit 21, and the revised backlight current value obtained by the revising unit, to control the backlight brightness of each backlight zone in the backlight area.

In some embodiments of the disclosure, the marking unit can be further configured to determine for any one backlight area whether the difference between the revised backlight current value and the present backlight current value is above a first preset threshold; when it is determined that the difference between the revised backlight current value and the present backlight current value is above the first preset threshold, to mark the revised backlight current value as valid so that the magnitude of a peak of a pulse signal of the backlight area is adjusted using the subsequently generated driving signal; when the it is determined that difference between the revised backlight current value and the present backlight current value is not above the first preset threshold, to mark the revised backlight current value as invalid so that the magnitude of the peak of the pulse signal of the backlight area is not adjusted using the subsequently generated driving signal.

In some embodiments of the disclosure, the second determining unit can be configured to multiply the backlight current value of the backlight area with the found gain to obtain the gain backlight current value of the backlight area.

In some embodiments of the disclosure, the apparatus can further include a marking unit configured to determine for any one backlight area whether the difference between the gain backlight current value and the present backlight current value is above a first preset threshold; when it is determined that the difference between the gain backlight current value and the present backlight current value is above the first preset threshold, to mark the gain backlight current value as valid so that the magnitude of a peak of a pulse signal of the backlight area is adjusted using the subsequently generated driving signal; when it is determined that the difference between the gain backlight current value and the present backlight current value is not above the first preset threshold, to mark the gain backlight current value as invalid so that the magnitude of the peak of the pulse signal of the backlight area is not adjusted using the subsequently generated driving signal.

In some embodiments of the disclosure, the apparatus can further include: a detecting unit configured to determine for any one backlight area whether the average backlight brightness obtained according to the currently determined backlight duty ratio of each backlight zone, and gain backlight current value of the backlight area is above a second preset threshold.

A revising unit is further included in the apparatus and the revising unit is configured, when it is determined by the detecting unit that the average backlight brightness obtained according to the currently determined backlight duty ratio of each backlight zone, and gain backlight current value of the backlight area is above the second preset threshold, to invoke and search a preset power adjustment curve for a power adjustment coefficient corresponding to the currently obtained backlight brightness of the backlight area, and to multiply the gain backlight current value with the power adjustment coefficient to obtain a revised backlight current value.

The outputting unit is further configured to generate the driving signal according to the backlight duty ratio of each backlight zone determined by the first determining unit, and the revised backlight current value obtained by the revising unit, to control the backlight brightness of each backlight zone in the backlight area.

In some embodiments of the disclosure, the marking unit can be further configured to determine for any one backlight area whether the difference between the revised backlight current value and the present backlight current value is above a first preset threshold; when it is determined that the difference between the revised backlight current value and the present backlight current value is above the first preset threshold, to mark the revised backlight current value as valid so that the magnitude of a peak of a pulse signal of the backlight area is adjusted using the subsequently generated driving signal; when it is determined that the difference between the revised backlight current value and the present backlight current value is not above the first preset threshold, to mark the revised backlight current value as invalid so that the magnitude of the peak of the pulse signal of the backlight area is not adjusted using the subsequently generated driving signal.

Figure 7:
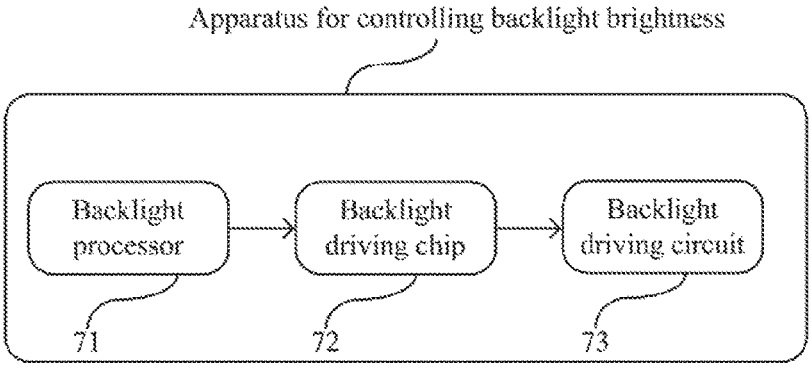
FIG. 7 is a schematic structural diagram of another apparatus for controlling backlight brightness according to some embodiments of the disclosure.

As illustrated in FIG. 7 which is a schematic structural diagram of an apparatus for controlling backlight brightness according to some embodiments of the disclosure, the apparatus for controlling backlight brightness includes a backlight processor 71, at least one backlight driving chip 72, and a backlight driving circuit 73.

The backlight processor 71 is configured to determine a backlight duty ratio of each backlight zone according to a backlight value of each backlight zone, where the backlight value of each backlight zone is determined by brightness data of an image zone corresponding to the backlight zone; and to determine a gain backlight current value of a backlight area according to an average backlight value of the backlight area, and a preset gain curve, where each backlight area corresponds to at least one backlight driving chip 72, and the at least one backlight driving chip controls in parallel more than one backlight zones in the backlight area corresponding to the backlight driving chip.

The backlight driving chip 72 is configured to generate a pulse modulation signal of each backlight zone according to the backlight duty ratio of the corresponding backlight zone and the gain backlight current value, and to send the pulse modulation signal to a backlight driving circuit 73.

The backlight driving circuit 73 is configured to adjust a backlight current of the corresponding backlight zone according to the pulse modulation signal.

In some embodiments of the disclosure, before the backlight processor is configured to generate the pulse modulation signal of each backlight zone according to the backlight duty ratio of the corresponding backlight zone and the gain backlight current value, the backlight processor 71 is further configured to generate a driving signal including gain backlight current value information and backlight duty ratio information, according to the gain backlight current value of the backlight area and the backlight duty ratio of each backlight zone in the backlight area; where the gain backlight current value information corresponds to the information of the gain backlight current value, and the backlight duty ratio information corresponds to the information of the backlight duty ratio.

Where the backlight driving chip configured to generate the pulse modulation signal of each backlight zone according to the backlight duty ratio of the corresponding backlight zone and the gain backlight current value is further configured:

to determine a magnitude of the peak of the pulse modulation signal by adjusting a reference voltage according to the gain backlight current value information of the driving signal; and to determine a duty ratio of the pulse modulation signal according to the backlight duty ratio information of the driving signal.

In some embodiments of the disclosure, the plurality of backlight areas in the backlight module correspond to at least two different preset gain curves, where there is a higher gain amplitude of a preset gain curve corresponding to a backlight area located in the central area of the backlight module than gain amplitudes of preset gain curves corresponding to the other backlight areas.

In some embodiments of the disclosure, the backlight processor configured to determine the gain backlight current value of the backlight area according to the average backlight value of the backlight area, and the preset gain curve is further configured:

to search for a gain corresponding to the average backlight value of each backlight area according to the average backlight value of the backlight area, and a preset gain curve; and:

to multiply a backlight current value of the backlight area with the found gain to obtain the gain backlight current value of the backlight area.

In some embodiments of the disclosure, before the backlight processor is configured to generate the pulse modulation signal of each backlight zone according to the backlight duty ratio of the corresponding backlight zone and the gain backlight current value, the backlight processor 71 is further configured:

when it is determined that the difference between the gain backlight current value and the present backlight current value is above the first preset threshold, to mark the gain backlight current value as valid so that a magnitude of a peak of reference voltage in the backlight driving chip corresponding to the backlight area is adjusted subsequently with the gain backlight current value; when it is determined that the difference between the gain backlight current value and the present backlight current value is not above the first preset threshold, to mark the gain backlight current value as invalid so that the magnitude of the peak of reference voltage in the backlight driving chip corresponding to the backlight area is not adjusted subsequently.

In some embodiments of the disclosure, after the backlight processor is configured to determine the gain backlight current value of the backlight area, the backlight processor 71 is further configured: when it is determined that the average backlight brightness obtained according to the currently determined backlight duty ratio of each backlight zone, and the gain backlight current value is above the second preset threshold, to invoke and search a preset power adjustment curve for a power adjustment coefficient corresponding to the currently obtained backlight brightness of the backlight area, and to multiply the gain backlight current value with the power adjustment coefficient to obtain a revised backlight current value.

The backlight driving chip 72 is further configured to generate the pulse modulation signal of each backlight zone according to the backlight duty ratio of the corresponding backlight zone and the revised backlight current value.

In some embodiments of the disclosure, before the pulse modulation signal of each backlight zone is generated according to the revised backlight current value of the backlight area, and the backlight duty ratio of the corresponding backlight zone in the backlight area, the backlight processor 71 is further configured: when it is determined that the difference between the revised backlight current value and the present backlight current value is above the first preset threshold, to mark the revised backlight current value as valid so that a magnitude of a peak of reference voltage in the backlight driving chip corresponding to the backlight area is adjusted subsequently with the revised backlight current value; when it is determined that the difference between the revised backlight current value and the present backlight current value is not above the first preset threshold, to mark the revised backlight current value as invalid so that the magnitude of the peak of reference voltage in the backlight driving chip corresponding to the backlight area is not adjusted subsequently.

Figure 8:
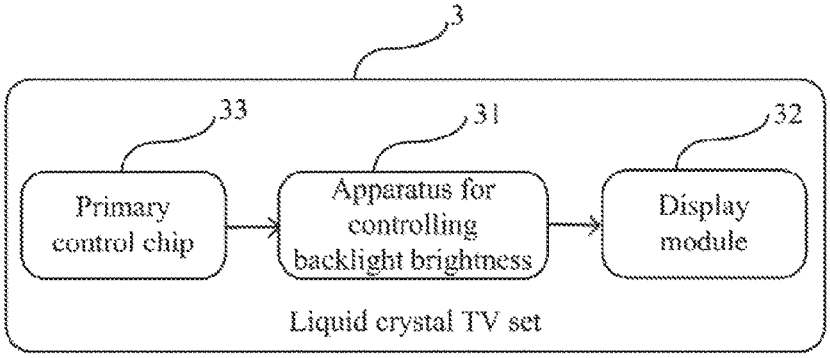
FIG. 8 is a simplified structural diagram of a liquid TV set according to some embodiments of the disclosure.

Furthermore some embodiments of the disclosure provide a display device, which can be a liquid TV set, and as illustrated in FIG. 8, the liquid TV set 3 can include an apparatus 31 for controlling backlight brightness, a display module 32, a primary control chip 33, etc. An external video data signal is input to the primary control chip 33, and decoded and then transmitted to the apparatus 31 for controlling backlight brightness, and the apparatus 31 for controlling backlight brightness, transmits the processed video data to a timing control chip of the display module 32 to drive a liquid crystal screen to display, and also transmits a determined backlight duty ratio of each backlight zone, and a gain backlight current value of a backlight area to a backlight driving circuit in the form of a driving signal for the purpose of backlight control.

In some embodiments of the disclosure, the apparatus for controlling backlight brightness in the display device can be embodied as the apparatus for controlling backlight brightness according to any one of the embodiments above. For example, the apparatus for controlling backlight brightness can be applicable to a backlight module including a plurality of backlight zones, each of which includes one or more point light sources, and which are controlled in parallel, and the apparatus for controlling backlight brightness can include:

A first determining unit is configured to determine a backlight duty ratio of each backlight zone according to a backlight value of each backlight zone, where the backlight value of each backlight zone is determined by brightness data of an image zone corresponding to the backlight zone.

A calculating unit is configured to calculate the average backlight value of each of a plurality of backlight areas in the backlight module.

A second determining unit is configured to search for a gain corresponding to the average backlight value of each backlight area according to the average backlight value of the backlight area, and a preset gain curve, and to determine a gain backlight current value of the backlight area according to the gain.

An outputting unit is configured to generate a driving signal according to the gain backlight current value of the backlight area and the backlight duty ratio of each backlight zone in the backlight area to control backlight brightness of each backlight zone in the backlight area.

In some embodiments of the disclosure, the plurality of backlight areas in the backlight module correspond to at least two different preset gain curves, where there is a higher gain amplitude of a preset gain curve corresponding to a backlight area located in the central area of the backlight module than gain amplitudes of preset gain curves corresponding to the other backlight areas.

In some embodiments of the disclosure, the second determining unit can be configured to multiply the backlight current value of the backlight area with the found gain to obtain the gain backlight current value of the backlight area.

In some embodiments of the disclosure, the display device can further include:

A marking unit is configured to determine for any one backlight area whether the difference between the gain backlight current value and the present backlight current value is above a first preset threshold; when it is determined that the difference between the gain backlight current value and the present backlight current value is above the first preset threshold, to mark the gain backlight current value as valid so that the magnitude of a peak of a pulse signal of the backlight area is adjusted using the subsequently generated driving signal; when it is determined that the difference between the gain backlight current value and the present backlight current value is not above the first preset threshold, to mark the gain backlight current value as invalid so that the magnitude of the peak of the pulse signal of the backlight area is not adjusted using the subsequently generated driving signal.

In some embodiments of the disclosure, the display device can further include:

A detecting unit is configured to determine for any one backlight area whether the average backlight brightness obtained according to the currently determined backlight duty ratio of each backlight zone, and gain backlight current value of the backlight area is above a second preset threshold.

A revising unit is configured, when it is determined by the detecting unit that the average backlight brightness obtained according to the currently determined backlight duty ratio of each backlight zone, and gain backlight current value of the backlight area is above the second preset threshold, to invoke and search a preset power adjustment curve for a power adjustment coefficient corresponding to the currently obtained backlight brightness of the backlight area, and to multiply the gain backlight current value with the power adjustment coefficient to obtain a revised backlight current value.

The outputting unit is further configured to generate the driving signal according to the backlight duty ratio of each backlight zone determined by the first determining unit, and the revised backlight current value obtained by the revising unit, to control the backlight brightness of each backlight zone in the backlight area.

In some embodiments of the disclosure, the marking unit can be further configured:

to determine for any one backlight area whether the difference between the revised backlight current value and the present backlight current value is above a first preset threshold; when it is determined that the revised backlight current value and the present backlight current value is above the first preset threshold, to mark the revised backlight current value as valid so that the magnitude of a peak of a pulse signal of the backlight area is adjusted using the subsequently generated driving signal; when it is determined that the revised backlight current value and the present backlight current value is not above the first preset threshold, to mark the revised backlight current value as invalid so that the magnitude of the peak of the pulse signal of the backlight area is not adjusted using the subsequently generated driving signal.

Furthermore some embodiments of the disclosure provide another display device, which can be a liquid TV set, the liquid TV set includes an apparatus for controlling backlight brightness, a display module, a primary control chip, etc. An external video data signal is input to the primary control chip, and decoded and then transmitted to the apparatus for controlling backlight brightness, and the apparatus for controlling backlight brightness, transmits the processed video data to a timing control chip of the display module to drive a liquid crystal screen to display, and also transmits a determined backlight duty ratio of each backlight zone, and a gain backlight current value of a backlight area to a backlight driving circuit in the form of a driving signal for the purpose of backlight control. Where the apparatus for controlling backlight brightness can be, for example, applicable to a backlight module including a plurality of backlight zones, each of which includes one or more point light sources, and the apparatus for controlling backlight brightness includes a backlight processor, at least one backlight driving chip, and a backlight driving circuit.

The backlight processor is configured to determine a backlight duty ratio of each backlight zone according to a backlight value of each backlight zone, where the backlight value of each backlight zone is determined by brightness data of an image zone corresponding to the backlight zone;

and to determine a gain backlight current value of a backlight area according to an average backlight value of the backlight area, and a preset gain curve, where each backlight area corresponds to at least one backlight driving chip, and the at least one of the backlight driving chip controls in parallel more than one backlight zones in the backlight area corresponding to the at least one backlight driving chip.

The backlight driving chip is configured to generate a pulse modulation signal of each backlight zone according to the backlight duty ratio of the corresponding backlight zone and the gain backlight current value, and to send the pulse modulation signal to a backlight driving circuit.

The backlight driving circuit is configured to adjust a backlight current of the corresponding backlight zone according to the pulse modulation signal.

In some embodiments of the disclosure, before the backlight processor is configured to generate the pulse modulation signal of each backlight zone according to the backlight duty ratio of the corresponding backlight zone and the gain backlight current value, the backlight processor is further configured to generate a driving signal including gain backlight current value information and backlight duty ratio information, according to the gain backlight current value of the backlight area and the backlight duty ratio of each backlight zone in the backlight area; where the gain backlight current value information corresponds to information of the gain backlight current value, and the backlight duty ratio information corresponds to information of the backlight duty ratio.

Where the backlight driving chip configured to generate the pulse modulation signal of each backlight zone according to the backlight duty ratio of the corresponding backlight zone and the gain backlight current value is further configured:

to determine a magnitude of the peak of the pulse modulation signal by adjusting a reference voltage according to the gain backlight current value information of the driving signal; and to determine a duty ratio of the pulse modulation signal according to the backlight duty ratio information of the driving signal.

In some embodiments of the disclosure, the plurality of backlight areas in the backlight module correspond to at least two different preset gain curves, where there is a higher gain amplitude of a preset gain curve corresponding to a backlight area located in the central area of the backlight module than gain amplitudes of preset gain curves corresponding to the other backlight areas.

In some embodiments of the disclosure, the backlight processor configured to determine the gain backlight current value of the backlight area according to the average backlight value of the backlight area, and the preset gain curve is further configured:

to search for a gain corresponding to the average backlight value of each backlight area according to the average backlight value of the backlight area, and a preset gain curve; and to multiplying a backlight current value of the backlight area with the found gain to obtain the gain backlight current value of the backlight area.

In some embodiments of the disclosure, before the backlight processor is configured to generate the pulse modulation signal of each backlight zone according to the backlight duty ratio of the corresponding backlight zone and the gain backlight current value, the backlight processor is further configured: when it is determined that the difference between the gain backlight current value and the present backlight current value is above the first preset threshold, to mark the gain backlight current value as valid so that a magnitude of a peak of reference voltage in the backlight driving chip corresponding to the backlight area is adjusted subsequently with the gain backlight current value; when it is determined that the difference between the gain backlight current value and the present backlight current value is not above the first preset threshold, to mark the gain backlight current value as invalid so that the magnitude of the peak of reference voltage in the backlight driving chip corresponding to the backlight area is not adjusted subsequently.

In some embodiments of the disclosure, after the backlight processor is configured to determine the gain backlight current value of the backlight area, the backlight processor is further configured: when it is determined that the average backlight brightness obtained according to the currently determined backlight duty ratio of each backlight zone, and the gain backlight current value is above the second preset threshold, to invoke and search a preset power adjustment curve for a power adjustment coefficient corresponding to the currently obtained backlight brightness of the backlight area, and to multiply the gain backlight current value with the power adjustment coefficient to obtain a revised backlight current value.

The backlight driving chip is further configured to generate the pulse modulation signal according to the backlight duty ratio of each backlight zone and the revised backlight current value.

In some embodiments of the disclosure, before the pulse modulation signal is generated according to the revised backlight current value of the backlight area, and the backlight duty ratio of each backlight zone in the backlight area, the backlight processor is further configured: when it is determined that the difference between the revised backlight current value and the present backlight current value is above the first preset threshold, to mark the revised backlight current value as valid so that a magnitude of a peak of reference voltage in the backlight driving chip corresponding to the backlight area is adjusted subsequently with the revised backlight current value; when it is determined that the difference between the revised backlight current value and the present backlight current value is not above the first preset threshold, to mark the revised backlight current value as invalid so that the magnitude of the peak of reference voltage in the backlight driving chip corresponding to the backlight area is not adjusted subsequently.

In some embodiments of the disclosure, the gains can be applied to the backlight current values of the different backlight areas so that there are different backlight current values of the different backlight areas, thus improving the contrast and the layering of the image being displayed more effectively; and if the contrast can not be well improved by adjusting the backlight duty ratios, or if the backlight brightness can not be further improved after the backlight duty ratios are adjusted to 100%, then the backlight current may be adjusted so that there are different gains corresponding to the backlight current in the respective backlight areas, and in this way, the different backlight areas can be treated differently to thereby improve the contrast between higher and lower brightness of the different backlight areas more effectively so as to improve the effect of the image display on the display device.

Furthermore some embodiments of the disclosure further provide a display device, which can include an apparatus for controlling backlight brightness, applicable to a backlight module including a plurality of backlight zones, each of which includes one or more point light sources, and which are controlled in parallel; and the apparatus for controlling backlight brightness can include a memory and one or more processors, where the memory can store one or more computer readable program codes, and the one or more processors can be configured to execute the one or more computer readable program codes to perform the functions according to any one of the embodiments above.

Those skilled in the art shall appreciate that the embodiments of the disclosure can be embodied as a method, a system or a computer program product. Therefore the disclosure can be embodied in the form of an all-hardware embodiment, an all-software embodiment or an embodiment of software and hardware in combination. Furthermore the disclosure can be embodied in the form of a computer program product embodied in one or more computer useable storage mediums (including but not limited to a disk memory, a CD-ROM, an optical memory, etc.) in which computer useable program codes are contained.

The disclosure has been described in a flow chart and/or a block diagram of the method, the device (system) and the computer program product according to the embodiments of the disclosure. It shall be appreciated that respective flows and/or blocks in the flow chart and/or the block diagram and combinations of the flows and/or the blocks in the flow chart and/or the block diagram can be embodied in computer program instructions. These computer program instructions can be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow chart and/or the block(s) of the block diagram.

These computer program instructions can also be stored into a computer readable memory capable of directing the computer or the other programmable data processing device to operate in a specific manner so that the instructions stored in the computer readable memory create an article of manufacture including instruction means which perform the functions specified in the flow(s) of the flow chart and/or the block(s) of the block diagram.

These computer program instructions can also be loaded onto the computer or the other programmable data processing device so that a series of operational steps are performed on the computer or the other programmable data processing device to create a computer implemented process so that the instructions executed on the computer or the other programmable device provide steps for performing the functions specified in the flow(s) of the flow chart and/or the block(s) of the block diagram.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A method for controlling backlight brightness, applicable to a backlight module comprising a plurality of backlight zones, each of which comprises one or more point light sources, the method comprising:

determining a backlight duty ratio of each backlight zone according to a backlight value of each backlight zone, wherein the backlight value of each backlight zone is determined by brightness data of an image zone corresponding to the backlight zone;

determining a gain backlight current value of a backlight area according to an average backlight value of the backlight area and a preset gain curve, wherein each backlight area corresponds to at least one backlight driving chip, and the at least one backlight driving chip controls in parallel more than one backlight zone in the backlight area corresponding to the at least one backlight driving chip;

generating a pulse modulation signal of each backlight zone according to the backlight duty ratio of the corresponding backlight zone and the gain backlight current value; and adjusting a backlight current of the corresponding backlight zone according to the pulse modulation signal.

2. The method according to claim 1, wherein before generating the pulse modulation signal of each backlight zone according to the backlight duty ratio of the corresponding backlight zone and the gain backlight current value, the method further comprises:

generating a driving signal including gain backlight current value information and backlight duty ratio information, according to the gain backlight current value of the backlight area and the backlight duty ratio of each backlight zone in the backlight area; wherein the gain backlight current value information corresponds to information of the gain backlight current value, and the backlight duty ratio information corresponds to information of the backlight duty ratio.

3. The method according to claim 2, wherein generating the pulse modulation signal of each backlight zone according to the backlight duty ratio of the corresponding backlight zone and the gain backlight current value comprises:

determining a magnitude of a peak of the pulse modulation signal by adjusting a reference voltage according to the gain backlight current value information of the driving signal; and determining a duty ratio of the pulse modulation signal according to the backlight duty ratio information of the driving signal.

4. The method according to claim 1, wherein the plurality of backlight areas correspond to at least two different preset gain curves, and wherein a gain amplitude of a preset gain curve corresponding to a backlight area located in a central area of the backlight module is higher than gain amplitudes of preset gain curves corresponding to other backlight areas.

5. The method according to claim 1, wherein determining the gain backlight current value of the backlight area according to the average backlight value of the backlight area, and the preset gain curve comprises:

searching for a gain corresponding to the average backlight value of each backlight area according to the average backlight value of the backlight area and a preset gain curve; and multiplying a backlight current value of the backlight area with the found gain to obtain the gain backlight current value of the backlight area.

6. The method according to claim 1, wherein before generating the pulse modulation signal of each backlight zone according to the backlight duty ratio of corresponding backlight zone and the gain backlight current value, the method further comprises:

when it is determined that a difference between the gain backlight current value and a present backlight current value is above a first preset threshold, marking the gain backlight current value as valid so that a magnitude of a peak of reference voltage in the backlight driving chip corresponding to the backlight area is adjusted subsequently with the gain backlight current value; and when it is determined that the difference between the gain backlight current value and the present backlight current value is not above the first preset threshold, marking the gain backlight current value as invalid so that the magnitude of the peak of reference voltage in the backlight driving chip corresponding to the backlight area is not adjusted subsequently.

7. The method according to claim 1, wherein after the determining the gain backlight current value of the backlight area, the method further includes:

when it is determined that an the average backlight brightness is obtained according to a currently determined backlight duty ratio of each backlight zone, and the gain backlight current value of the backlight area is above a second preset threshold, invoking and searching a preset power adjustment curve for a power adjustment coefficient corresponding to the currently obtained backlight brightness of the backlight area, and multiplying the gain backlight current value with the power adjustment coefficient to obtain a revised backlight current value; and generating the pulse modulation signal of each backlight zone according to the revised backlight current value of the backlight area and the backlight duty ratios of corresponding backlight zones in the backlight area.

8. The method according to claim 7, wherein before the pulse modulation signal of each backlight zone is generated according to the revised backlight current value of the backlight area and the backlight duty ratio of the corresponding backlight zone in the backlight area, the method further comprises:

when it is determined that a difference between the revised backlight current value and a present backlight current value is above a first preset threshold, marking the revised backlight current value as valid so that a magnitude of a peak of reference voltage in the backlight driving chip corresponding to the backlight area is adjusted subsequently with the revised backlight current value; and when it is determined that the difference between the revised backlight current value and the present backlight current value is not above the first preset threshold, marking the revised backlight current value as invalid so that the magnitude of the peak of reference voltage in the backlight driving chip corresponding to the backlight area is not adjusted subsequently.

9. An apparatus for controlling backlight brightness, applicable to a backlight module comprising a plurality of backlight zones, each of which comprises one or more point light sources, the apparatus comprising:

a backlight processor configured to determine a backlight duty ratio of each backlight zone according to a backlight value of each backlight zone, wherein the backlight value of each backlight zone is determined by brightness data of an image zone corresponding to the backlight zone, and the backlight processor configured to determine a gain backlight current value of a backlight area according to an average backlight value of the backlight area and a preset gain curve, wherein each backlight area corresponds to at least one backlight driving chip, and the at least one backlight driving chip controls in parallel more than one backlight zones in the backlight area corresponding to the at least one backlight driving chip;

wherein the at least one backlight driving chip is configured to generate a pulse modulation signal of each backlight zone according to the backlight duty ratio of the corresponding backlight zone and the gain backlight current value, and to send the pulse modulation signal to a backlight driving circuit; and wherein the backlight driving circuit is configured to adjust a backlight current of the corresponding backlight zone according to the pulse modulation signal.

10. The apparatus according to claim 9, wherein before the backlight processor is configured to generate the pulse modulation signal of each backlight zone according to the backlight duty ratio of the corresponding backlight zone and the gain backlight current value, the backlight processor is further configured to generate a driving signal including gain backlight current value information and backlight duty ratio information, according to the gain backlight current value of the backlight area and the backlight duty ratio of each backlight zone in the backlight area; wherein the gain backlight current value information corresponds to information of the gain backlight current value, and the backlight duty ratio information corresponds to information of the backlight duty ratio.

11. The apparatus according to claim 9, wherein the backlight driving chip configured to generate the pulse modulation signal of each backlight zone according to the backlight duty ratio of the corresponding backlight zone and the gain backlight current value is further configured:

to determine a magnitude of the peak of the pulse modulation signal by adjusting a reference voltage according to the gain backlight current value information of the driving signal; and to determine a duty ratio of the pulse modulation signal according to the backlight duty ratio information of the driving signal.

12. The apparatus according to claim 9, wherein the plurality of backlight areas in the backlight module correspond to at least two different preset gain curves, and wherein a gain amplitude of a preset gain curve corresponding to a backlight area located in a central area of the backlight module is higher than gain amplitudes of preset gain curves corresponding to other backlight areas.

13. The apparatus according to claim 9, wherein the backlight processor configured to determine the gain backlight current value of the backlight area according to the average backlight value of the backlight area and the preset gain curve is further configured:

to search for a gain corresponding to the average backlight value of each backlight area according to the average backlight value of the backlight area and a preset gain curve; and:

to multiply a backlight current value of the backlight area with the found gain to obtain the gain backlight current value of the backlight area.

14. The apparatus according to claim 9, wherein before the backlight processor is configured to generate the pulse modulation signal of each backlight zone according to the backlight duty ratio of corresponding backlight zone and the gain backlight current value, the backlight processor is further configured:

when it is determined that a difference between the gain backlight current value and a present backlight current value is above a first preset threshold, to mark the gain backlight current value as valid so that a magnitude of a peak of reference voltage in the backlight driving chip corresponding to the backlight area is adjusted subsequently with the gain backlight current value; and when it is determined that the difference between the gain backlight current value and the present backlight current value is not above the first preset threshold, to mark the gain backlight current value as invalid so that the magnitude of the peak of reference voltage in the backlight driving chip corresponding to the backlight area is not adjusted subsequently.

15. A liquid crystal display device, comprising a liquid crystal screen and an apparatus for controlling backlight brightness applicable to a backlight module comprising a plurality of backlight zones, each of which comprises one or more point light sources, the apparatus comprising:

a backlight processor configured to determine a backlight duty ratio of each backlight zone according to a backlight value of each backlight zone, wherein the backlight value of each backlight zone is determined by brightness data of an image zone corresponding to the backlight zone, and the backlight processor configured to determine a gain backlight current value of a backlight area according to an average backlight value of the backlight area and a preset gain curve, wherein each backlight area corresponds to at least one backlight driving chip, and the at least one of the backlight driving chip controls in parallel more than one backlight zones in the backlight area corresponding to the at least one backlight driving chip;

wherein the at least one backlight driving chip is configured to generate a pulse modulation signal of each backlight zone according to the backlight duty ratio of the corresponding backlight zone and the gain backlight current value, and to send the pulse modulation signal to a backlight driving circuit; and wherein the backlight driving circuit is configured to adjust a backlight current of the corresponding backlight zone according to the pulse modulation signal.

16. The liquid crystal display device according to claim 15, wherein the plurality of backlight areas in the backlight module correspond to at least two different preset gain curves, and wherein a gain amplitude of a preset gain curve corresponding to a backlight area located in a central area of the backlight module is higher than gain amplitudes of preset gain curves corresponding to other backlight areas.

17. The liquid crystal display device according to claim 15, wherein the backlight processor configured to determine the gain backlight current value of the backlight area according to the average backlight value of the backlight area and the preset gain curve is further configured:

to search for a gain corresponding to the average backlight value of each backlight area according to the average backlight value of the backlight area and a preset gain curve; and to multiply a backlight current value of the backlight area with the found gain to obtain the gain backlight current value of the backlight area.

18. The liquid crystal display device according to claim 15, wherein before the backlight processor is configured to generate the pulse modulation signal of each backlight zone according to the backlight duty ratio of the corresponding backlight zone and the gain backlight current value, the backlight processor is further configured:

when it is determined that a difference between the gain backlight current value and a present backlight current value is above a first preset threshold, to mark the gain backlight current value as valid so that a magnitude of a peak of reference voltage in the backlight driving chip corresponding to the backlight area is adjusted subsequently with the gain backlight current value; and when it is determined that the difference between the gain backlight current value and the present backlight current value is not above the first preset threshold, to mark the gain backlight current value as invalid so that the magnitude of the peak of reference voltage in the backlight driving chip corresponding to the backlight area is not adjusted subsequently.

19. The liquid crystal display device according to claim 15, wherein after the backlight processor is configured to determine the gain backlight current value of the backlight area, the backlight processor is further configured:

when it is determined that an average backlight brightness is obtained according to a currently determined backlight duty ratio of each backlight zone, and the gain backlight current value is above a second preset threshold, to invoke and search a preset power adjustment curve for a power adjustment coefficient corresponding to the currently obtained backlight brightness of the backlight area, and to multiply the gain backlight current value with the power adjustment coefficient to obtain a revised backlight current value; and wherein the backlight driving chip is further configured to generate the pulse modulation signal of each backlight zone according to the backlight duty ratio of the corresponding backlight zone and the revised backlight current value.

20. The liquid crystal display device according to claim 19, wherein before the pulse modulation signal of each backlight zone is generated according to the revised backlight current value of the backlight area and the backlight duty ratio of the corresponding backlight zone in the backlight area, the backlight processor is further configured:

when it is determined that a difference between the revised backlight current value and a present backlight current value is above a first preset threshold, to mark the revised backlight current value as valid so that a magnitude of a peak of reference voltage in the backlight driving chip corresponding to the backlight area is adjusted subsequently with the revised backlight current value; and when it is determined that the difference between the revised backlight current value and the present backlight current value is not above the first preset threshold, to mark the revised backlight current value as invalid so that the magnitude of reference voltage in the backlight driving chip corresponding to the pulse signal of the backlight area is not adjusted subsequently.

* * * * *